US006370850B1

(12) United States Patent
Zilka

(10) Patent No.: US 6,370,850 B1
(45) Date of Patent: Apr. 16, 2002

(54) SADDLE PAD

(76) Inventor: Amy M. Zilka, 5025 Crown St., Minnetonka, MN (US) 55345

( * ) Notice: Subject to any disclaimer, the term of this patent is extended or adjusted under 35 U.S.C. 154(b) by 0 days.

(21) Appl. No.: 09/545,827

(22) Filed: Apr. 7, 2000

(51) Int. Cl.[7] ..... B68B 3/08
(52) U.S. Cl. ..... 54/66
(58) Field of Search ..... 54/37.1, 44.1, 54/41.1, 44.5, 44.7, 65, 66

(56) References Cited

U.S. PATENT DOCUMENTS

| | | | | | |
|---|---|---|---|---|---|
| 897,629 | A | * | 9/1908 | Koch | 54/41.1 |
| 4,827,701 | A | * | 5/1989 | Gonzales | 54/66 |
| 5,058,367 | A | * | 10/1991 | Evertson | 54/66 |
| 5,456,072 | A | * | 10/1995 | Stern | 54/44.5 |
| 5,802,823 | A | * | 9/1998 | Woods | 54/66 |
| 6,050,067 | A | * | 4/2000 | Knight et al. | 54/66 |
| 6,067,781 | A | * | 5/2000 | Ford et al. | 54/66 |

OTHER PUBLICATIONS

Professional's Choice, "*Product Catalog*", pp. 98 and 99 (Date Unknown).
State Line Tack, The Discount Tack Store, "*1998 Annual Discount Catalog*" 3 pages (1998).
Libertyville Saddle Shop, "*English Equestrian 2000*", p. 37 (2000).
Tack 'n Togs Merchandising "*1999–2000 Buyers Guide*", pp. A54–A56 (1999–2000).

* cited by examiner

*Primary Examiner*—Charles T. Jordan
*Assistant Examiner*—Elizabeth Shaw
(74) *Attorney, Agent, or Firm*—Merchant & Gould PC

(57) ABSTRACT

The present invention provides devices and methods for reducing compressive and concussive forces to the back of an animal. Such compressive and concussive forces can cause pain, soreness and discomfort to an animal carrying a load on its back. The invention takes into account the structural and physiological characteristics of an animal's back that correspond to areas of high concussive and/or compression forces between the animal's back and a load applied to its back. In one embodiment, the invention provides a pad for use between a load interface and the animal's back. The pad is made of at least two distinct materials, each having a different resistance to compression and ability to absorb concussive and compressive forces. In one embodiment, a first material is sized to fit over a substantial portion of the animal's back covered by the load interface. A second material, of different physical characteristics from the first material, is positioned on or within the first material to cover selected areas of the animal's back which are subject to increased compressive and concussive forces between the load interface and the animal's back. The second material preferably has greater resistance to compression and an increased ability to absorb concussive and compressive forces than does the first material.

26 Claims, 8 Drawing Sheets

SADDLE PAD

FIELD OF THE INVENTION

The present invention is related to the field of saddle pads and other such padding for placement between an animal's back and a saddle, pack or other load bearing equipment used on the backs of animals such as horses, mules, donkeys, camels, llamas, ostriches, etc. Specifically, the invention provides a pad that has greater resistance to compression and a higher absorbency of concussive and compressive forces on the animal's back than do other available products used for such purposes.

BACKGROUND OF THE INVENTION

Previous to the present invention, saddle pads were made primarily from a single type of padding material such as wool, felt, foam or a variety of other material in an effort to provide cushioning between the animal and the load being applied to its back. These materials may be ineffective because of their low resistance to compression and poor ability to absorb a sufficient amount of compressive and concussive forces applied to the animal's back by a carried load.

Additional problems with previously used materials are that they often wear out easily, become abrasive and distorted over time, and have to be layered in an attempt to increase the cushioning effect. Even the most expensive, high-end pads are deficient in providing a significant amount of durability, resistance to deformation and ability to absorb and dissipate compressive and concussive forces from the load.

Some of the results from these deficiencies in the previous pads include soreness, pain and discomfort for the animal and even a reduction in comfort and satisfaction for the rider/user. The saddle pad industry is in need of a product that remedies these deficiencies and deals with soreness and pain caused by loads applied to the animal's back.

SUMMARY OF THE INVENTION

The present invention provides an apparatus and method for reducing pain, soreness and discomfort to an animal carrying a load on its back. The invention takes into account the structural and physiological characteristics of an animal's back that correspond to areas of high concussive and/or compressive forces between the animal's back and a load being applied to its back.

In one embodiment, the invention provides a pad for use between a load interface and the animal's back. In one embodiment the pad is made of at least two distinct materials, each having a different resistance to compression and ability to absorb concussive and compressive forces. The first material is typically of a larger surface area than a second material and is sized to fit over the portion of the animal's back covered by the load interface. The first material is divided into two sides that meet over the animal's spine. Each side has a width dimension and first and second ends that create a length dimension. A midline region includes the intersection of the two sides and covers the loin muscles on each side of the animal's spine along a midline length.

A second material, of different physical characteristics from the first material, is positioned within the area of the first material preferably at points subject to greatest compressive or compressive forces between the load interface and the animal's back. The second material preferably has greater resistance to compression, an increased ability to absorb concussive and compressive forces and greater resilience than does the first material. In some embodiments, it is foreseen that a third or more materials be used at certain selected locations.

DETAILED DESCRIPTION OF THE INVENTION

Figure 1:
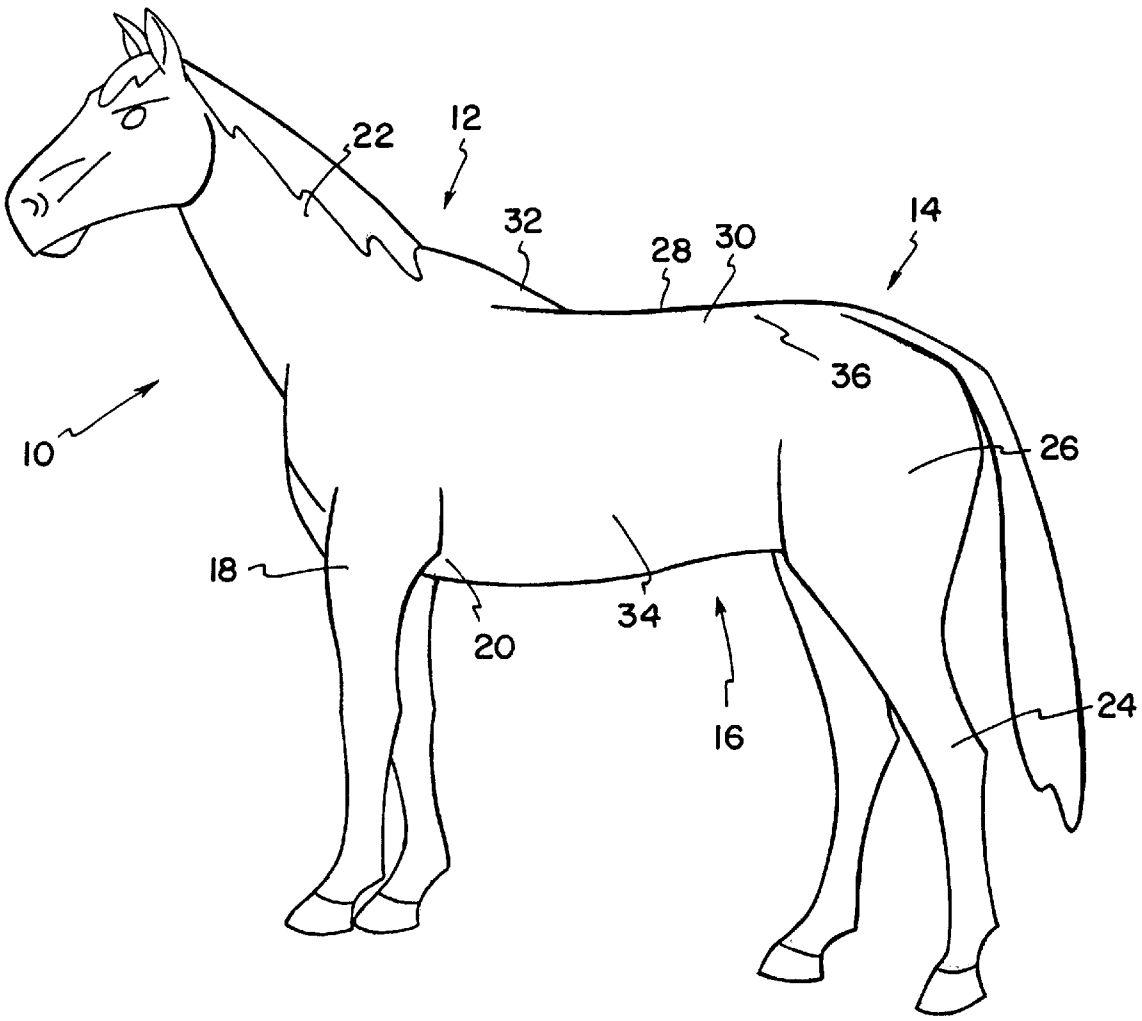
FIG. 1 is a side view of a horse representing one example of a load carrying animal to which the present invention can be applied.

The present invention provides a device and method for reducing pain, soreness and discomfort to an animal carrying a load on its back. As used herein, "animal" includes an animal which may carry a load. Such animals include, for example, horses, mules, donkeys, camels, lamas, or other animals which are used for carrying a load. A "load" is defined as a person, pack or other force applied on an animal's back. Loads are applied to an animal's back by various means including an animal's participation in activities such as pulling, packing or riding (racing, trail riding, rodeoing, endurance riding, hunting, jumping, etc.). In general, the present invention can be used anytime it is desired to decrease compressive and/or concussive forces caused by the dynamics of the load on an animal's back, thereby reducing pain and soreness to the animal. "Load dynamics" refers to load forces from a load in motion. In the present invention, static loads applied to an animals back become dynamic loads when the animal moves relative to the load or the load moves relative to the animal (caused by independent movement of the animal or the load such as from a rider moving on the animal's back).

As used herein, the term "load interface" refers to that portion of the load which contacts the animal's back in the absence of a pad such as that described for the present invention. "Loin" or "loin region" refers to the loin muscle on either side of the spine on the animal's back. The loin region is a region on the animal's back which can be subject to the greatest compressive forces exerted from the load at the load interface. The loin region covers a portion of the animal's back adjacent the spine a distance that varies depending on the physiological structure of the animal.

For purposes of illustrating the elements of the present invention, a horse will be used as a typical animal to which the present invention will be applied. However, use of the horse as an example is not intended to limit the scope of the types or uses of the invention. The Western and English styles of pads illustrated and described herein correspond to just two of a variety of saddle and pad styles used by the horse industry. Other types or styles of saddles and pads to which the present principles of the invention could be applied include the general categories of racing (horse racing, steeple chase, barrel racing, rodeo), show (dressage, hunter jumper, western pleasure), recreation (endurance, trail riding, school horses) and miscellaneous applications (polo, special need horses). It will be appreciated that variations of the present invention can be applied not only to one or all of the aforementioned horse industries, but also to any application wherein a load is applied to the back of an animal.

Some exemplary embodiments of a device of the invention and its components are described below. The configuration of a pad of the present invention is determined by the configuration of the animal's back to which the invention is to be applied. In a typical embodiment, a pad disclosed herein for a load carrying animal provides a pad between a load interface and an animal's back. Generally, the invention includes at least two materials, a first material and a second material, which when used together substantially cover that surface area of the animal's back which would be in contact with the load interface.

As used herein the first material includes any type of material which provides the preferred properties of durability, resistance to deformation, shock absorbency and resilience. "Durability" is defined as a material's resistance to wear and deterioration when used for its intended purpose over an extended period of time. "Resistance to deformation" refers to a material's ability to maintain its original shape or form when a load is exerted upon the material. "Shock absorbency" is defined as a material's ability to absorb the forces exerted on the material from the concussion applied by the load to the animal's back or from the animal to the load. "Resilience" refers to a material's ability to recover its shape and size after deformation caused especially by compressive forces.

Examples of suitable material for use as the first material include polyurethane ester, polyurethane felted, polyurethane ether, polyvinylchloride, silicone closed cell or any type of open cell or closed cell polymeric foam. An example of a suitable first material is the product R600U Polyurethane Ester, Open Cell High Density Foam available from Illbruck, Inc., 3800 Washington Ave. N., Minneapolis, Minn. 55412. Generally, open cell foams are preferred over closed cell foams for use as the first material because of its ability to absorb an animal's perspiration.

As used herein the second material includes any type of material which provides the desired properties of resistance to deformation and high absorbency of concussive and compressive forces. Additional preferred, but not required, second material properties include high resilience and in a preferred embodiment, the ability to distribute forces exerted on the pad over a greater portion of the animal's back. Examples of suitable second material include urethane, polyurethane elastomer, thermoplastic elastomer, silicone rubber and neoprene rubber. An example of a suitable polyurethane elastomer material is the polyurethane product available from TEC Interface Systems, 820 Sundial Dr, Waite Park, Minn. 56387. TEC polyurethane, or the equivalent thereof, possesses the desired second material properties listed above.

It will be appreciated that a third, fourth or more additional materials could be used at different locations on the pad in combination with the first and second materials. These additional materials would be added to the pad at locations wherein the cushioning needs for an animal back could be better met by the characteristics of the additional material than by the first or second material used. Suitable material for use as a third, fourth or more additional materials includes but is not limited to those materials listed as suitable second materials.

The first material is preferably of a uniform thickness throughout its length and width with possible variation in thickness in locations where the second material is positioned. The thickness of the second material will typically be selected based on the cushioning needed for a particular load application. In some embodiments, the second material will be of the same thickness as the first material and will thus take the place of the first material at that location on the pad. In a preferred embodiment, the first material is reduced in thickness at locations where the second material is added to the pad. The second material is of a thickness such that the combination of the first and second material thickness' at the locations where the second material is added to the pad is equal to the unreduced first material thickness.

A suitable thickness for the first material is in the range of 5–200 mm, typically 10–100 mm and preferably 10–30 mm. A suitable thickness for the second material is in the range of 2–200 mm, typically 5–50 mm and preferably 8–25 mm. In one presently preferred embodiment, the thickness of the first material is about 18 mm and the second material has a thickness of about 10 mm.

It is possible for the second, third or more materials to be detachable from the first material wherever used in any embodiment, however, it is preferred that the second material be permanently attached to the first material. Removal of a "permanently attached" material would damage all or some of the integrity of one or more of the materials used.

DETAILED DESCRIPTION OF ILLUSTRATED EMBODIMENT

With reference to the several drawing figures, FIGS. 1–8B, in which identical elements are numbered identically throughout, a description of some embodiments of a pad according to the present invention will now be provided. The figures are explanatory of the elements of the invention and are not intended to be limiting. Throughout the specification, guidance is provided by examples as applied to saddle pads, but these examples are also not meant to be limiting.

FIG. 1 is a side view of a horse 10 used for illustrating portions of a horse's body which will be referred to throughout the specification. A horse is used for explanatory purposes in the description of the illustrated embodiments, but the invention applies to other animals.

The horse 10 has a front section 12, a rear section 14, and an abdomen section 16 between the front and rear sections. Horse 10 further has a front leg 18, girth area 20, neck 22, rear leg 24, hind quarters 26 and spine 28. On either side of spine 28 is loin muscle 30 which extends from withers 32 to croup 36. Ribs 34 extend downward from the spine in the region between front leg 18 and rear leg 24.

Figure 2:
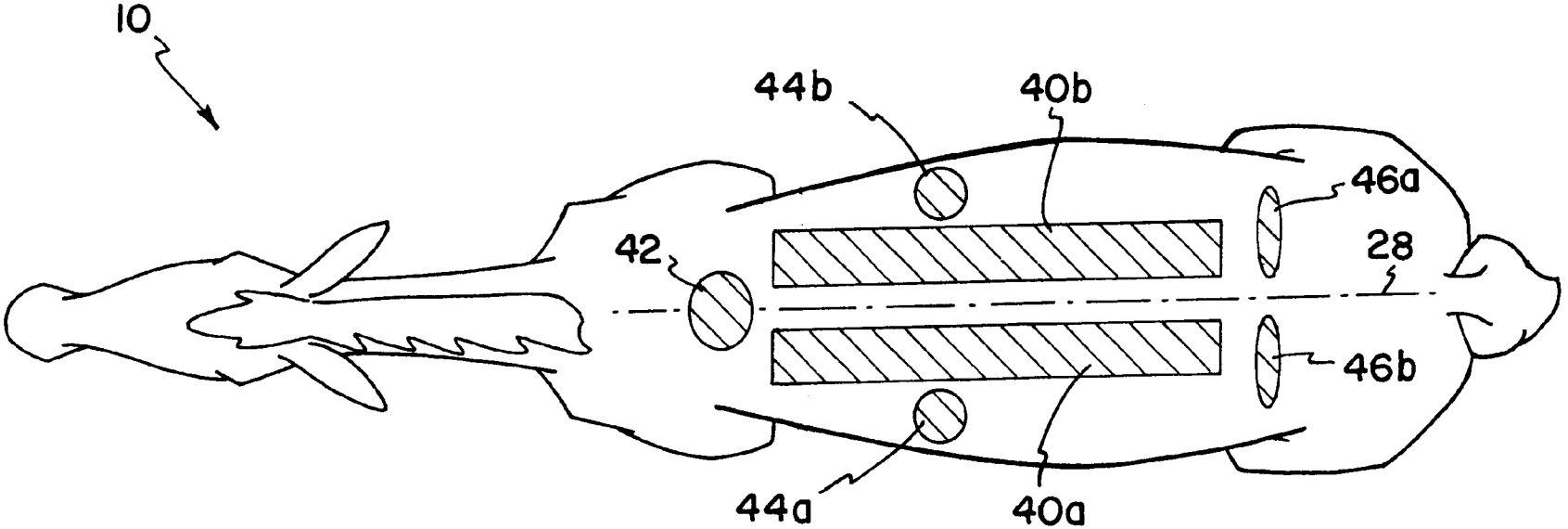
FIG. 2 is a top view of the horse of FIG. 1 illustrating regions on the horse's back subjected to large forces from a load applied to the horse's back.

FIG. 2 is a top view of horse 20 for illustrating areas which are subjected to the greatest compressive and concussive forces on the horse's back due to a typical load applied to the horse's back. Shaded regions 40*a* and 40*b* represent an area covering the loin muscles on opposite sides of spine 28. Most types of saddles create the greatest amount of compressive forces on these regions of the animal's back. The present invention emphasizes reducing compressive and concussive forces in these regions and therefore reduces pain and discomfort to the animal associated with the load.

Shaded region 42 represents the withers area illustrated in FIG. 1. Withers 32 can receive large forces from a load because it is a raised surface relative to the curvature of a horse's back. Shaded regions 44*a* and 44*b* represent areas of high compressive and concussive forces near girth 20 or ribs 34 of the horse caused by knee pressure from the rider. Shaded regions 46*a* and 46*b* represent areas of high compressive and concussive forces near croup 36 of the horse's back.

FIGS. 3A–8B are each bottom views of embodiments of the present invention which incorporate the functional aspects of the invention. The embodiments shown are exemplary and are not intended to limit the scope of the configurations that incorporate the principles of the invention.

Figure 3A:
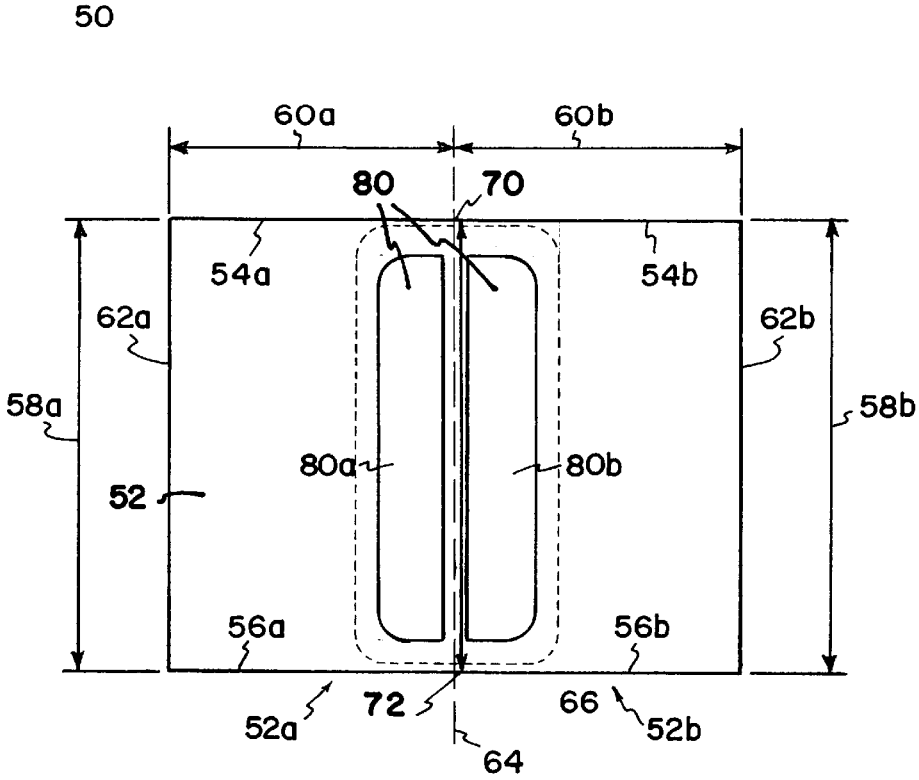
FIG. 3A is a bottom plan view of one embodiment of a Western style pad illustrating the basic elements of the present invention.
Figure 3B:
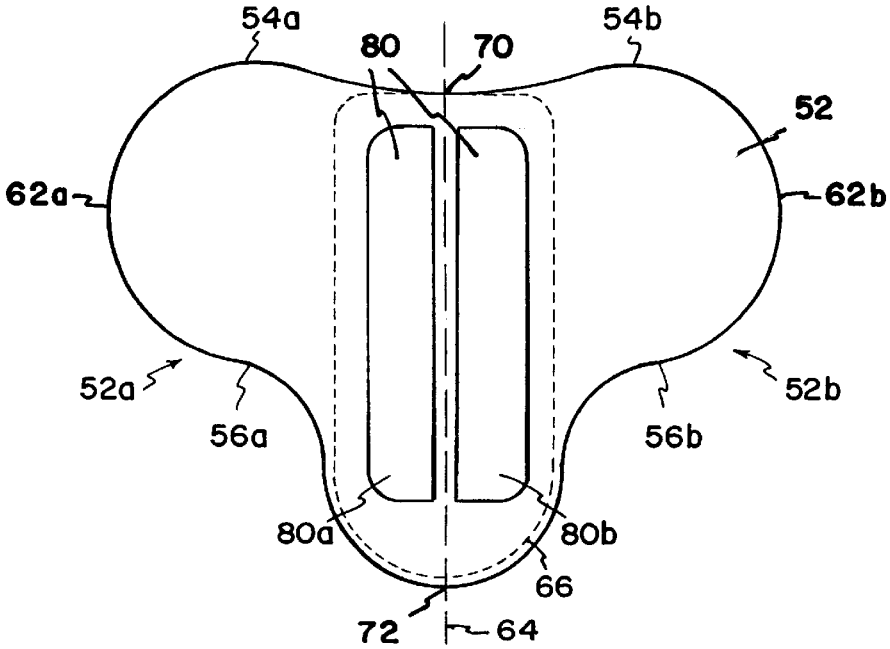
FIG. 3B is a bottom plan view of one embodiment of an English style pad illustrating the basic elements of the present invention.

FIGS. 3A and 3B are examples of suitable Western and English style saddle pads, respectively, that incorporate the basic elements of the present invention. FIG. 3A shows the several dimensions used to define the materials used for a saddle pad 50 according to the invention. Pad 50 is not limiting as to the type or style of pads described and illustrated herein.

A first material 52 is divided into two sides 52*a* and 52*b*. Side 52*a* has a first end 54*a*, a second end 56*a*, and a length dimension 58*a* extending from the first end to the second end. Side 52*a* also has a width dimension 60*a* extending from first side edge 62*a* to a midline 64 that connects sides 52*a* and 52*b*. Side 52*b* also has a first end 54*b*, a second end 56*b* and a length dimension 62*b* extending from the first end to the second end. Side 52*b* has a width dimension 60*b* extending from a second side edge 62*b* to the midline 64. Midline region 66 (shown with dotted line) includes midline 64 and a length dimension 68 that extends from a first midline end 70 to a second midline end 72.

Each side 52*a* and 52*b* of the first material have portions of second material 80 positioned on substantially parallel to midline 64. Second material portion 80*a* extends from first end 54*a* in the direction of the second end 56*a*, which when applied to the animal covers a substantial portion of the loin region 40*a* (FIG. 2) that is covered by the load interface. Second material 80*b* is of the same shape and dimensions as 80*a* and is positioned on side 52*b* an equal distance from midline 64. It is appreciated that the shape and positioning of second material portions 80*a* and 80*b* on first material sides 52*a* and 52*b* can vary depending upon the shape and size of the load interface. The size and shape of the load interface is dependent on such variables as the size of the animal, the type of load being applied and the animal's physiological structure.

The following figures illustrate additional embodiments of the present invention dealing primarily with variations in design and positioning of the second material.

Figure 4A:
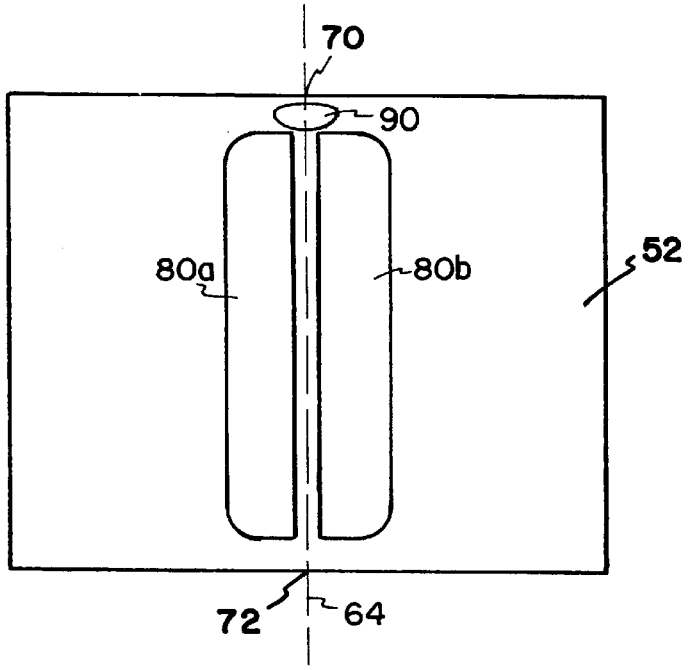
FIG. 4A is a bottom plan view of a second embodiment of a Western style pad illustrating the basic pad elements of FIG. 3A with a portion of second or third material covering the withers on the animal's back.
Figure 4B:
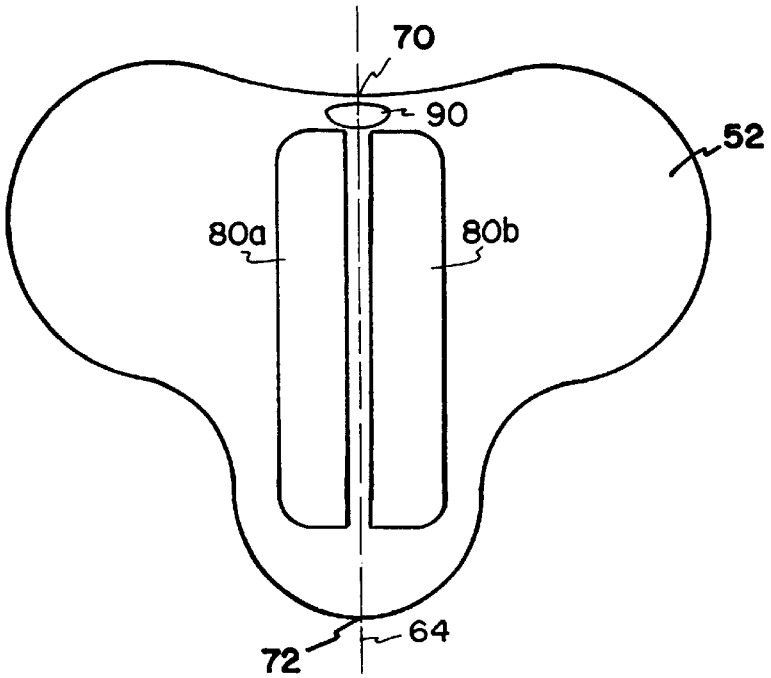
FIG. 4B is a bottom plan view of a second embodiment of an English style pad illustrating the basic pad elements of FIG. 3B with a portion of second material covering the withers on the animal's back.

FIGS. 4A and 4B illustrate an alternative embodiment having additional second or third material 90 centered about midline 64 near midline first end 70. Second material 90 is provided in addition to second material portions 80*a* and 80*b* in a size and shape to cover a portion (or the entirety) of withers region 42 (FIG. 2). It is anticipated that second or third material 90 could be either independent of or incorporated into second material portions 80*a* and 80*b*, so long as withers region 42 is covered.

Figure 5A:
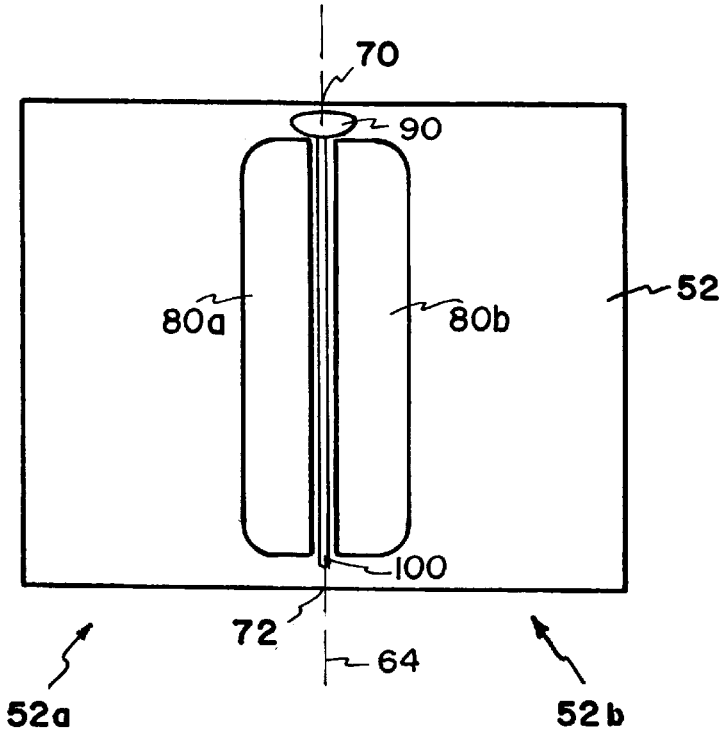
FIG. 5A is a bottom plan view of a third embodiment of a Western style pad illustrating the elements of FIG. 4A with a portion of second, third or fourth material covering the spine on the animal's back.
Figure 5B:
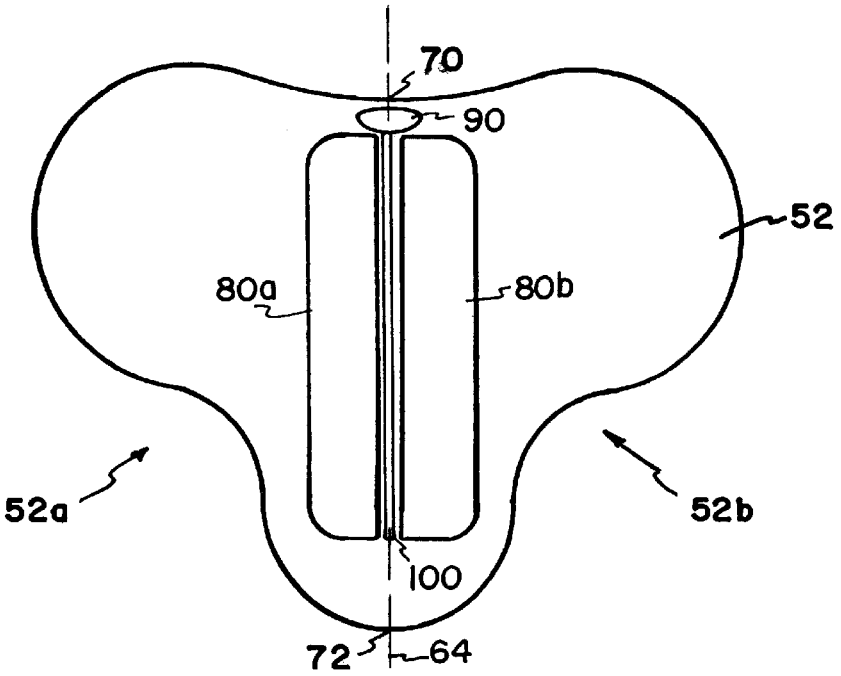
FIG. 5B is a bottom plan view of a third embodiment of an English style pad illustrating the elements of FIG. 4B with a portion of second, third or fourth material covering the spine on the animal's back.

FIGS. 5A and 5B illustrate a further alternative embodiment which includes second or third material 90, as shown in FIGS. 4A and 4B, with an additional line of second third or fourth material 100. Material 100 is also centered on midline 64 and extends from first midline end 70 towards second midline end 72. Material 100 preferably covers at least the load interface with spine 28 on the animal's back. Additional material 100 is shown in FIGS. 5A and 5B as a strip of second, third or fourth material that is unconnected to second material portions 80*a* and 80*b*. It is anticipated that material 100 could be modified in a variety of ways, including for example extending material 100 the entire midline length, connecting material 100 to second or third material portion 90, or integrating material 100 into second material portions 80*a* and 80*b*.

Figure 6A:
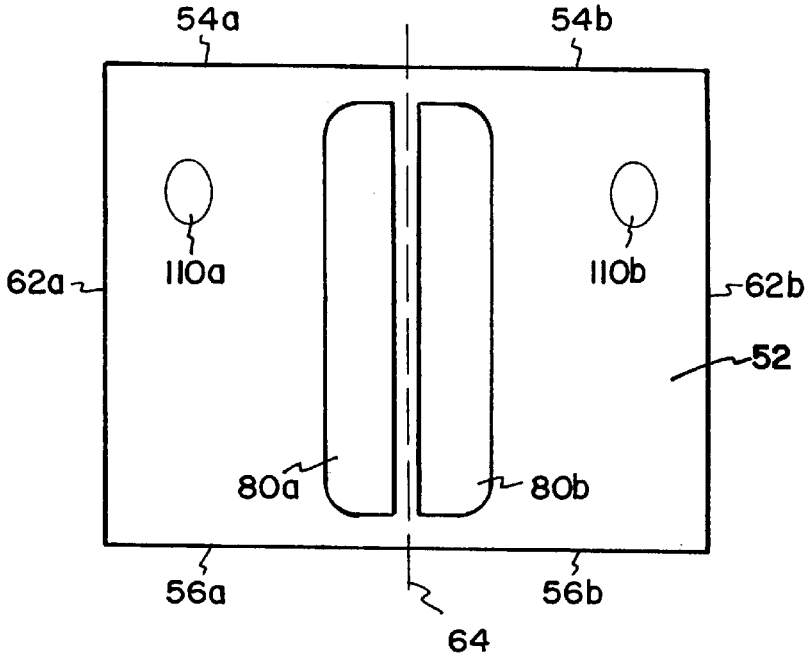
FIG. 6A is a bottom plan view of a fourth embodiment of a Western style pad illustrating the basic elements of FIG. 3A with a portion of second, third or fourth material covering the region which would be below the rider's knee in use.
Figure 6B:
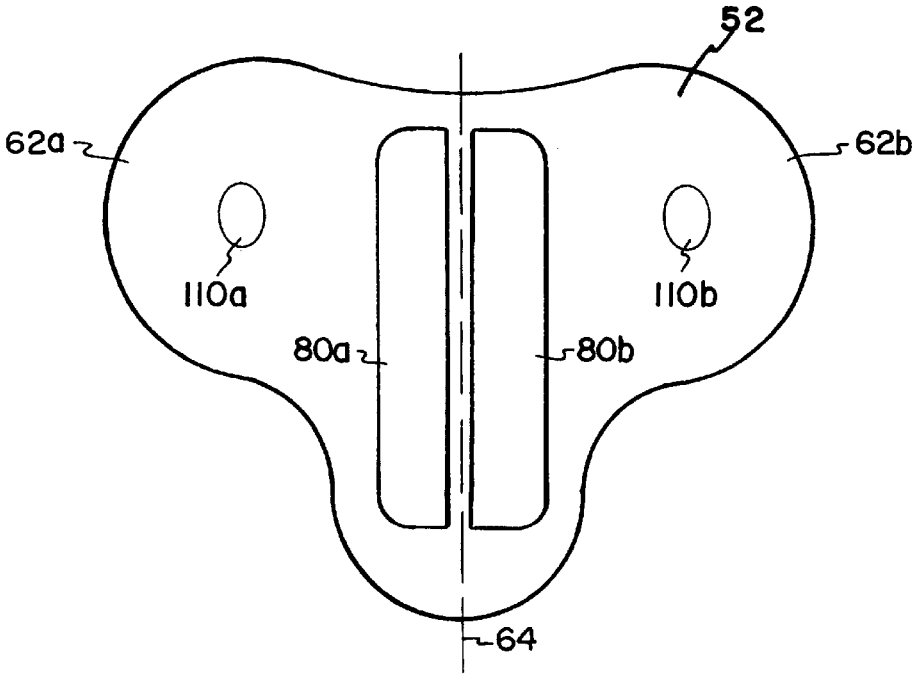
FIG. 6B is a bottom plan view of a fourth embodiment of an English style pad illustrating the basic elements of FIG. 3B with a portion of second, third or fourth material covering the region which would be below the rider's knee in use.

FIGS. 6A and 6B illustrate an alternative embodiment having additional second, third or fourth material portions, 110*a* and 110*b*, to the second material 80 shown in FIGS. 3A and 3B. Material portion 110*a* is positioned on the first material between the first end 54*a* and second end 56*a* near first side edge 62*a*. The positioning of material 110*a* is anticipated to cover region 46*a* (FIG. 2) below the rider's knee. Material portion 110*b* is of the same size and dimension as portion 110*a* and is positioned to cover region 46*b* (FIG. 2).

Figure 7A:
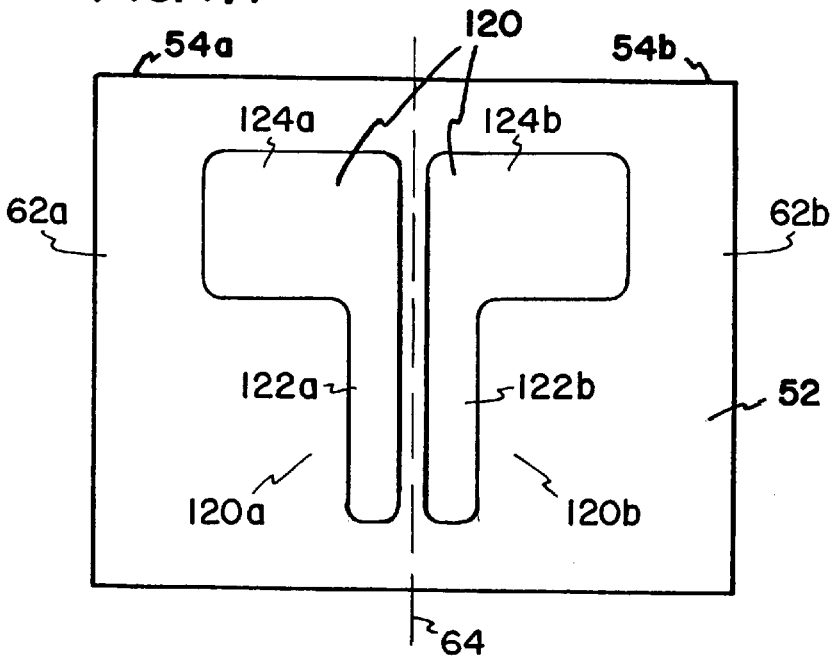
FIG. 7A is a bottom plan view of a fifth embodiment of a Western style pad illustrating an L-shaped second material design.
Figure 7B:
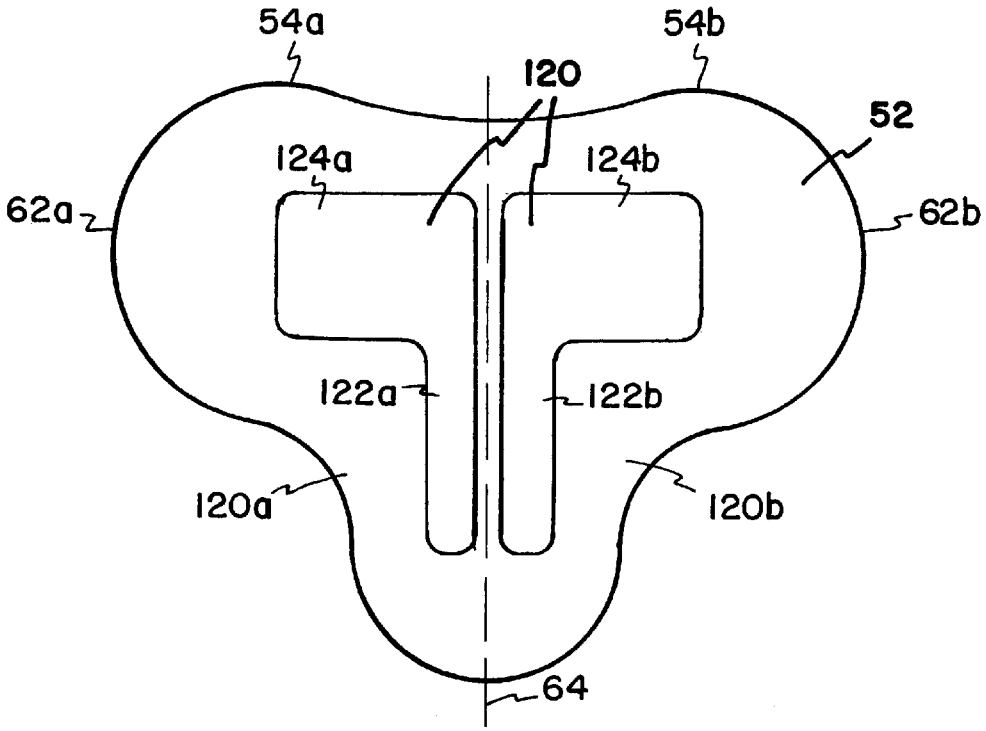
FIG. 7B is a bottom plan view of a fifth embodiment of an English style pad illustrating an L-shaped second material design.

FIGS. 7A and 7B illustrate a further alternative embodiment of the present invention. The Western style pad shown in FIG. 7A has a first material 52 and a second material 120. Second material 120 has a first portion 120*a* and a second portion 120*b*, each having a substantially L-shaped configuration. Second material portion 120*a* has a lateral portion 122*a* extending substantially parallel to midline 64 and substantially covering loin region 40*a* (FIG. 2). Second material portion 120*a* also has a normal portion 124*a* which extends in a normal direction from midline 64 near first end 54*a*. Second material portion 120*b* has a lateral portion 122*b* and a normal portion 124*b*, identical to those portions of second material portion 120*a*, and is located on the pad in a position mirrored across midline 64, opposite from portion 120*a*.

In some embodiments it is preferred that normal portions 124*a* and 124*b* completely cover areas of the animal's back subject to the greatest compressive and concussive forces near first end 54*a* of the pad caused by knee pressure against the saddle or tightening of the girth strap. Knee pressure on this area of the animal's back often causes irritation and inflammation. Tightening of the girth strap is required to keep some types of saddles properly mounted to the horse's back. The girth strap creates increased compressive forces that can cause soreness and discomfort on the animal's back.

Figure 8A:
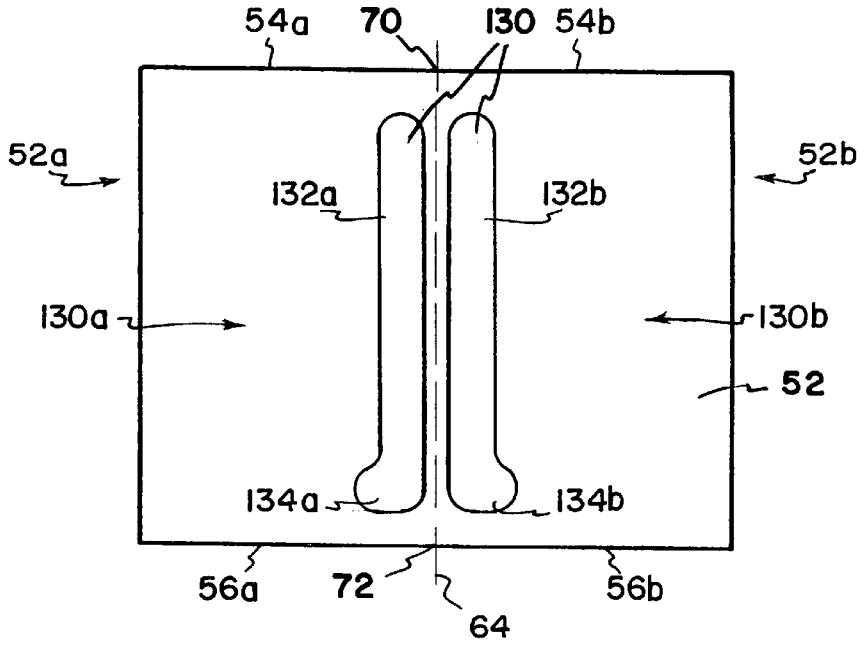
FIG. 8A is a bottom plan view of a sixth embodiment of a Western style pad illustrating additional second material covering the croup region on the animal's back.
Figure 8B:
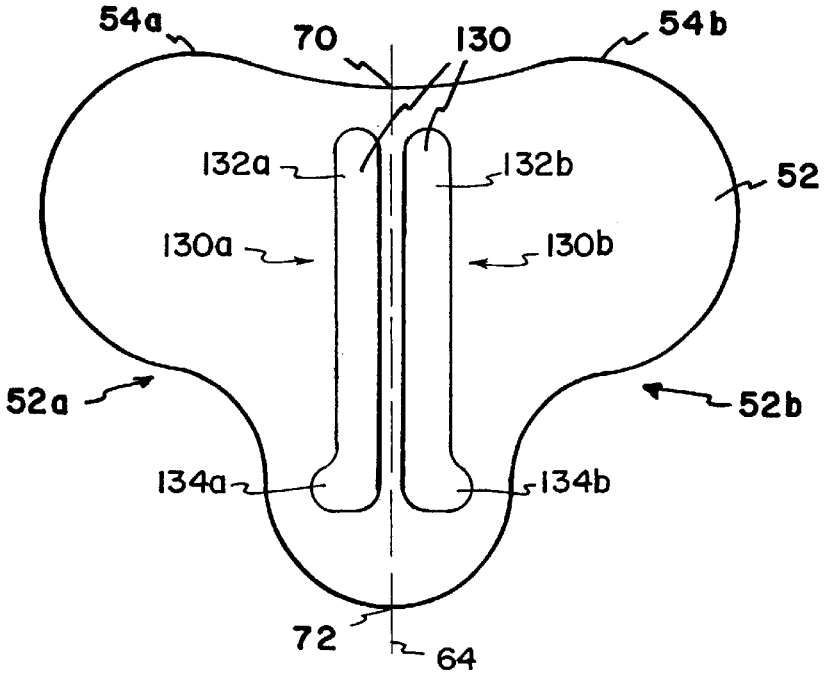
FIG. 8B is a bottom plan view of a sixth embodiment of an English style pad illustrating additional second material covering the croup region on the animal's back.

FIGS. 8A and 8B illustrate an alternative embodiment of the present invention. The Western style pad shown in FIG. 8A has first material 52 and second material 130. Second material 130 has a first portion 130*a* and second portion 130*b*. Second material portion 130*a* is positioned on first material side 52*a* and has a lateral portion 132*a* extending substantially parallel to midline 64 that substantially covers loin region 40*a* (FIG. 2). Second material portion 130*a* is of a similar shape to portion 80*a* (FIG. 3A) but with an additional portion of second, third or fourth material 134*a* added near second end 56*a* (FIG. 3A). Material 134*a* is anticipated to cover a portion of croup 46*a* (FIG. 2). Second material portion 130*b* is of the same size and dimension as 130*a* and is mirrored across midline 64 onto side 52*b*. It is anticipated that additional material 134*a* and 134*b* will decrease pain and discomfort to the animal due to concussive and compressive forces on or around croup 46*a*, 46*b* (FIG. 2).

It will be apparent to one of ordinary skill in the art that many changes and modifications can be made in the invention without departing from the spirit or scope of the appended claims.

I claim:

1. A pad comprising:

a first material having a size sufficient to fit over a portion of an animal's back, the size being at least as great as the area of an interface of a load positioned on the animal's back and comprising:

a first side having a first end and a second end forming a first length dimension and the first side having a first width dimension normal to the first length dimension;

a second side having a first end and a second end forming a second length dimension and the second side having a second width dimension normal to the second length dimension; and a midline region including an intersection of the first and second sides, the midline region having a first end and a second end and a midline length dimension; and a second material, different from the first material, having a greater resistance to compressive forces and greater absorbency of concussive forces than the first material and positioned on the pad at selected points subject to increased compression between the interface and the animal's back; and wherein the first material has a first thickness, and a second thickness at areas underlying the second material, and the second material has a thickness, and wherein the combined first material second thickness and the second material thickness is substantially similar to the first material first thickness.

2. The pad of claim 1 wherein a first portion of the second material is positioned on the first side of the pad and a second portion of the second material is positioned on the second side of the pad.

3. The pad of claim 2 wherein when in use the first portion of the second material is positioned over a first loin of the animal's back and the second portion of the second material is positioned over a second loin of the animal's back.

4. The pad of claim 3 wherein when in use the third portion of the second material is positioned over a portion of a withers of the animal's back.

5. The pad of claim 3 wherein a portion of the second material is positioned over a spine of the animal's back between the first and second loins.

6. The pad of claim 3 wherein a portion of the second material is positioned on the first side and the second side such that when in use the second material is between a rider's knees and the animal.

7. The pad of claim 2 wherein a third portion of the second material is positioned in the midline region of the pad.

8. The pad of claim 1 wherein the midline length dimension is at least as great as the first and second length dimensions.

9. The pad of claim 8 wherein the midline length dimension is greater than each of the first and second length dimensions.

10. The pad of claim 8 wherein the first material has a total width dimension comprising the sum of the first and second width dimensions, and wherein the first material has a range of total width dimension to midline length dimension ratio of about 0.75:1 to 2:1.

11. The pad of claim 2 wherein the first portion and the second portion of the second material each have a lateral portion positioned over that portion of the loin muscle subject to the load and a normal portion substantially covering that portion of the withers and a girth of the animal subject to the load.

12. The pad of claim 1 wherein the first material is a synthetic material having properties of durability, resistance to deformation, shock absorbency and resilience.

13. The pad of claim 1 wherein the first material second thickness is zero thickness.

14. A method for reducing compressive forces between a back of an animal and an interface of a load positioned on the animal's back, the method comprising:

selecting a pad, the pad having:

a first material having a size sufficient to fit over a portion of an animal's back at least as great as the area of the interface, a first side having a first end and a second end forming a first length dimension and the first side having a first width dimension normal to the first length dimension, a second side having a first end and a second end forming a second length dimension and the second side having a second width dimension normal to the second length dimension, a first material first thickness and a first material second thickness, and a midline region including an intersection of the first and second sides, the midline region having a first end and a second end and a midline length dimension;

a second material secured to the first material, the second material having a thickness, the second material being different from the first material and having a greater resistance to compression and greater absorbency of concussive and compressive forces than the first material, relative to the first material at points subject to greatest compression between the interface and the animal's back; and wherein the pad has a constant pad thickness equal to the first material first thickness and wherein the combined first material second thickness and the second material thickness is substantially similar to the first material first thickness;

putting the pad on an animal's back between an interface of a load and the animal's back.

15. The method according to claim 14 wherein a first portion of the second material is positioned on the first side and a second portion of the second material is positioned on the second side.

16. The method according to claim 15 wherein the first portion of the second material is positioned over the first loin of the animal's back and the second portion of the second material is positioned over a second loin of the animal's back.

17. The method according to claim 15 wherein when in use the third portion of the second material is positioned over the animal's spine between the first and second loins.

18. The method according to claim 17 wherein a portion of the second material is positioned on the first side and the second side such that when in use the second material is between a rider's knees and the animal.

19. The method according to claim 15 wherein a third portion of the second material is positioned in the midline region.

20. The method according to claim 14 wherein the midline length dimension is at least as great as the first and second length dimensions.

21. The pad of claim 14 wherein the first material second thickness underlies the second material at points on the pad at points on the pad where the second material is secured to the first material.

22. An animal having a back for receiving a load and a pad for use between an interface of the load and the animal's back, wherein the pad comprises a first material of a size at least the area of the interface, the first material having first and second thicknesses, and a second material different from the first material, having a thickness and a greater resistance to compressive and concussive forces than the first material, secured to the first material at points subject to greatest compression between the interface and the animal's back, and wherein the pad thickness remains substantially constant, the pad thickness being equal to the first material first thickness and the combination of the first material second thickness and the second material thickness.

23. The pad of claim 22 wherein the first material second thickness underlies the second material at points on the pad where the second material is secured to the first material.

24. A pad consisting of:

a first layer of a first material having a size sufficient to fit over a portion of an animal's back, the size being similar in shape and area to the area of an interface of a load positioned on the animal's back and comprising: a first side, a second side, and a midline region including an intersection of the first and second sides;

a second layer of a second material, the second material being different from the first material and positioned on the pad at selected points subject to increased compression between the interface and the animal's back; and a substantially constant pad thickness.

25. The pad of claim 24 wherein the first material second thickness underlies the second material at points on the pad where the second material is positioned on the first material.

26. A pad comprising:

a first material having a size sufficient to fit over a portion of an animal's back, the size being at least as great as the area of an interface of a load positioned on the animal's back and comprising:

a first side having a first end and a second end forming a first length dimension and the first side having a first width dimension normal to the first length dimension;

a second side having a first end and a second end forming a second length dimension and the second side having a second width dimension normal to the second length dimension; and a midline region including an intersection of the first and second sides, the midline region having a first end and a second end and a midline length dimension; and a second material, different from the first material, having a greater resistance to compressive forces and greater absorbency of concussive forces than the first material and positioned on the pad at selected points subject to increased compression between the interface and the animal's back; and wherein the first material has a first thickness, and a second thickness at areas underlying the second material, and the second material has a thickness, and wherein the combined first material second thickness and the second material thickness is substantially similar to the first material first thickness; and wherein the pad consists of two layers, a first layer of a first material and a second layer of a second material; and wherein the first and second materials are synthetic materials, the first material being a suitable open or closed cell foam material selected from the group consisting of polyurethane ester, polyurethane felted, polyurethane ether, polyvinylchloride, and silicone closed cell; and wherein the second material is selected from the group consisting of urethane, polyurethane elastomer, thermoplastic elastomer, silicone rubber, and neoprene rubber.

* * * * *